US005102272A

United States Patent [19]

Woods et al.

[11] Patent Number: 5,102,272

[45] Date of Patent: Apr. 7, 1992

[54] FOLDING VOID FILLER

[76] Inventors: James L. Woods; Robert F. Thomasino, both of 4230 Broadway, Denver, Colo. 80216

[21] Appl. No.: 468,188

[22] Filed: Jan. 22, 1990

[51] Int. Cl.[5] ..... B61D 45/00; B63B 25/24; B65D 81/04

[52] U.S. Cl. ..... 410/154; 206/593; 410/155; 410/121

[58] Field of Search ..... 206/586, 591, 593, 453, 206/320, 521; 410/121, 118, 117, 154, 155; 229/DIG. 1, 93

[56] References Cited

U.S. PATENT DOCUMENTS

| | | | |
|---|---|---|---|
| 2,609,136 | 9/1952 | Sider | 206/593 X |
| 3,951,730 | 4/1976 | Wennberg et al. | 206/521 X |
| 4,375,852 | 3/1983 | Johnson et al. | 229/DIG. 1 X |
| 4,386,881 | 6/1983 | Liebel | 410/121 X |
| 4,494,897 | 1/1985 | Rogers | 206/593 X |
| 4,951,823 | 8/1990 | Butkus et al. | 206/586 |

*Primary Examiner*—Robert J. Spar
*Assistant Examiner*—Brian K. Dinicola
*Attorney, Agent, or Firm*—James E. Pittenger

[57] ABSTRACT

An expandable void filler which includes a plurality of expandable hollow, elongated, box-like tubes which can be stacked one on the other and joined together along their common surfaces. Separate interface panels can be sandwiched between the individual tubular members to provide additional lateral compressive strength. The individual tubes are held in the expanded position by individual folding panels which extend inwardly across the interior opening within and have sufficient size to wedge against the opposite sidewall as well as the top and bottom of the structure. These panels alternate from one side of the tube to the other and are staggered so as to not be vertically aligned between the stacked tubular members. A flange member can be attached to the uppermost tube to support the void filler in proper position between the cargo loaded within a transporting vehicle. The double tubular configuration of the present invention can be formed by using a single sheet of material such as corrugated cardboard with the sheet folded along predetermined lateral fold lines to form the complete structure.

13 Claims, 3 Drawing Sheets

FOLDING VOID FILLER

FIELD OF THE INVENTION

This invention is directed to an expandable void filler or dunnage device which is used to support and control shifting of loads during transit. It is more specifically directed to an expandable void filler which is fabricated from corrugated cardboard and arranged to expand to a rigid structure for use in supporting a load during transit.

BACKGROUND OF THE INVENTION

In transporting various types of cargo within railroad freight cars, trucks or other vehicles, invariably, the horizontal dimension of the loads do not completely fill the interior space within the vehicle. Thus, there are voids usually left between the various loads whether it is between the load itself or between the load and the walls of the vehicle. If this void is left unattended, the load or cargo during movement of the vehicle will shift and in some cases cause considerable damage to the load and/or vehicle.

In the past, it has been common when shipping a large volume of materials to unitize these materials on pallets or other support devices. The boxes, bags or loose objects which are intended to be shipped are stacked to a reasonable height and the goods are either banded together to secure them as a unit or they are wrapped, usually with a plastic sheet material to hold the load in a unitized or palletized configuration. As previously stated, even though there may be an attempt to size the palletized units to fit within the cargo bay of the rail car, ship, truck or other vehicle, variations in the dimensions of the loads cause voids or spaces to occur.

In the past, shippers have been generally successful in stuffing or forcing packing or other loose material between the load units to prevent them from shifting or moving. Invariably, this is a very cumbersome and unacceptable way to ship various materials since the packing materials have to be handled and stored between use. In addition, the packing usually is substantially loose and thus, extremely hard to handle and control, thus adding cost to the shipment.

Another way of solving this problem is the use of air bags which can be inserted between the various palletized or unitized loads and inflated. These work very well as long as the air bags are not punctured and hold their pressure. However, during transit, if the bags deflate, then the loads are free to move with possible consequential damage. In addition, the air bags are very expensive to manufacture especially if they have sufficient strength and rigidity to prevent puncture and yet be light enough to be easily handled. Thus, even though the bags can be manufactured to remain substantially inflated, they became so heavy that they are difficult to handle and in addition, are quite expensive to manufacture.

Others over a period of years have tried to use folded, corrugated cardboard as a dunnage device or void filler. These early devices were merely folded layers of cardboard inserted to fill the void between the elements of the load. Later attempts were made to use folded boxes which could be unfolded or expanded when used and thus, occupy a greater space and fill the void more efficiently. More recently, however, various types of void fillers have been utilized which provide arrangements for folding the sheet material into a tubular configuration or a U-shaped configuration with various slotted cross members used to hold the filler material in position. Flanges have been attached to the top of the void filler to support the mass between the various loads whether on the top or in between various layers of the load.

In most cases, these devices have been designed so that they can be reused and readily stored. This means that they can be disassembled or taken apart or folded so that they can be reduced to a relatively small or flat object taking up a minimal amount of storage space.

All of the devices which have been utilized up to the present time have various known problems or flaws which can be primarily related to their complexity as well as their expense in manufacture. What is really needed is a void filler which will provide the substantial strength and rigidity necessary to support the loads while in use and yet, will be very thin, lightweight and inexpensive to manufacture. This is the primary object of the present invention.

INFORMATION DISCLOSURE STATEMENT

The following section is provided in order to comply with the applicants' acknowledged duty to inform the Patent Office of any pertinent information of which they are aware.

The patent to Sewell, et al. (U.S. Pat. No. 4,372,717) shows an expandable honeycomb or cellular void filler which is made from corrugated paper board. The entire unit is suspended from the upper structure of the load by a flange which is attached to the uppermost portion of the void filler and which is large enough to overlap the load on each side. The void filler expands into a plurality of horizontal cell rows under its own weight. Vertically aligned, centrally positioned, diamond-shaped cells provide vertical support and horizontal rigidity for the unit, providing strength and rigidity to the unit and hold the loads in proper position.

The VanMersbergen patent (U.S. Pat. No. 4,444,535) shows a single corrugated blank which is folded for use as a void filler or dunnage plug. The blank is folded to form a flanged beam which is attached to the side wall of a vehicle or vessel in which the cargo is transported. The ends of the flanges are folded inwardly so as to fit into precut slots to provide a box structure to form a rigid unit for supporting the cargo or load. The unit is designed to be attached to either the side wall of the vehicle or the side of the actual cargo or load.

The Rogers patent (U.S. Pat. No. 4,494,897) shows a collapsible corrugated void filler which provides an expandable outer tube and a second tube-like member inside the first and arranged at right angles. As the side walls are contracted the interior tube-like member expands which provides lateral strength for separating freight in railroad cars, trucks and the like. The upper part of the outer tube is supported by a cap sheet to form the outer flanges for supporting the device.

A second Rogers patent (U.S. Pat. No. 4,363,579) also shows a portable void filler for preventing damage to loads mounted within a transporting vehicle. This device apparently has to be assembled from various cut pieces of corrugated material. The side pieces fit into slots precut within the central member. The side members form support flanges which allow the device to be suspended in the load either from a top portion of the load or it can be attached directly to the side wall of the vehicle.

The Montgomery, et al. patent (U.S. Pat. No. 2,196,470) discloses corrugated cardboard spacers which are used in connection with the loading and storing of heavy, compact loads, especially steel sheets and plates. Corrugated cardboard sheets are folded and slotted to form a corrugated filler having a plurality of lateral diamond-shaped spaces. These spaces are filled with rolled, corrugated cardboard material to form a substantially solid layered filler. Other embodiments showing layered configurations and formed corrugated sheet configurations are included.

The Jaski (U.S. Pat. No. 3,850,112), Vargen (U.S. Pat. No. 3,424,108), and Brucks (U.S. Pat. No. 3,421,451) patents essentially show various types of expandable filler devices which utilize the folding of perforated and slotted sheets of corrugated cardboard. The sheets are formed usually into U-shape channels and are interconnected to form a substantially rigid structure. Some of these fillers are anchored to the walls of the vehicle in which the cargo is loaded or is positioned so as to be suspended from the uppermost edge of the cargo or is supported on the floor of the vehicle.

The Clifford patent (U.S. Pat. No. 2,980,573) shows an expandable ventilating void filler which utilizes corrugated paper board or cardboard, cloth, metal or other suitable combinations of these materials. The fillers are formed from relatively thick sheets of material which are scored and attached to each other at predetermined locations. In addition, the joint areas are formed from longitudinally corrugated materials so that air or fluid can pass longitudinally through the filler and through the joints to provide ventilation around the cargo or load. The filler device can be stored in a flat configuration or expanded when in use as a void filler to restrict movements of the cargo or load.

The Kauffman patent (U.S. Pat. No. 3,581,675) discloses a support for an expandable honeycomb type of void filler wherein integrated wire loops are provided at the uppermost portion of the void filler. The wire loops can be expanded outwardly to overlap the top surfaces of the cargo so that the void filler can be supported by the load and expanded downwardly, to fill the void and prevent movement of the cargo during shipment.

SUMMARY OF THE INVENTION

This invention is directed to a novel void filler which is extremely easy and quick to use and extremely light and inexpensive to manufacture. The void filler according to the present invention is a simple longitudinal corrugated paper board or cardboard, four-sided, elongated, open-ended, tube which can be suspended by a flange within or from the top of the cargo. During storage and transportation, the void filler is folded so as to be relatively flat and when used expanded or unfolded into a rectangular or square hollow cross section with side panels folded inwardly across the interior space to contact at least the opposite side and hold the expanded void filler in a rigid configuration.

Any number of expanded longitudinal tubes can be attached to each other to form the void filler according to the present invention depending upon the overall vertical height which is needed. Thus, the elongated tubes can be permanently attached to each other by suitable adhesives or other methods such as double-sided tape. By the same token, the elongated tubes can be attached by removable fasteners such as flanged pins and slidable squeeze-fasteners, nuts and bolts or any other type of suitable fasteners. In this way, the individual tubes can be attached to each other in the field to adapt or customize the void filler for the actual needs of the user.

Throughout this application the applicants will describe what is considered to be the preferred embodiment of this invention wherein the device includes a double-stack and elongated tubular structure. As will be explained later, in one variation this structure can be formed from a single sheet of corrugated cardboard as desired depending upon the necessary strength requirements. Another variation is disclosed which forms the individual expandable tubes from separate pieces of corrugated sheet material and then attaches these tubes or tubular members together along their common surface. An interface sheet which can be formed from either single corrugated sheet material or other more rigid sheet material such as double or triple layered corrugated cardboard, pressed board, plywood or any other suitable material can be sandwiched between the tubular members to add lateral compressive strength to the structure in order to rigidly hold the cargo or load securely within the transporting vehicle. Thus, the present invention can be customized as desired to handle any specified load requirements. By the same token, the structure as provided in this invention can be easily collapsed for storage and transportation and later instantly expanded for reuse as desired.

One of the important features of the present invention is the novel arrangement in which a panel is cut on three sides in a surface of each tubular member. The fourth edge of the panel is folded so as to form a fold line on the side of the member so that the panel can fold inwardly across the interior space within the tubular member. The length and height of the panel is arranged to correspond with the interior cross-sectional dimensions of the hollow tubular member so that the free edges of the panel will contact the adjacent and/or opposite side of the tubular member with sufficient force to hold the panel across the interior of the tube-like member in a generally perpendicular position with respect to the sidewalls. In most cases, the inwardly folding panels will be spaced a short distance inwardly from each end of the tubular member.

In order to provide additional rigidity to the tubular member structure, the panels can be alternated from one sidewall and the second from the opposite sidewall so as to not compromise the sidewall strength of the structure. Although any suitable number of panels can be provided in the tubular box-like structure, it has been found that two panels generally provide sufficient rigidity to the expanded structure and provide sufficient lateral compressive strength to the overall structure.

In the double-stacked tubular configuration, the cut-outs for the folding panels are staggered on each side of the elongated tubular members so that the cut-outs for the folding panels do not align vertically on any one side. This arrangement is desirable to maintain vertical strength in the overall void filler structure which will be described later.

With the structure formed in this way, the void filler according to the present invention can be easily expanded and collapsed when desired and yet, form a completely satisfactory and rigid structure having sufficient strength to retain and hold the cargo or load in proper position during transit. Although throughout this application, reference will be made to the use of corrugated cardboard sheet material, it is to be understood that any suitable sheet material may be used which can be cut and folded as desired. Besides corrugated cardboard or paper board, the material could be various types of fiber materials, plastics or metal. It is to be understood that any material is suitable for use with the present invention so long as it can be easily cut and folded so as to be expandable and collapsible when desired.

Other features of this invention will appear in the following description and appended claims, reference being made to the accompanying drawings forming a part of this application where in like reference characters designate corresponding parts in the various views.

Figure 1:
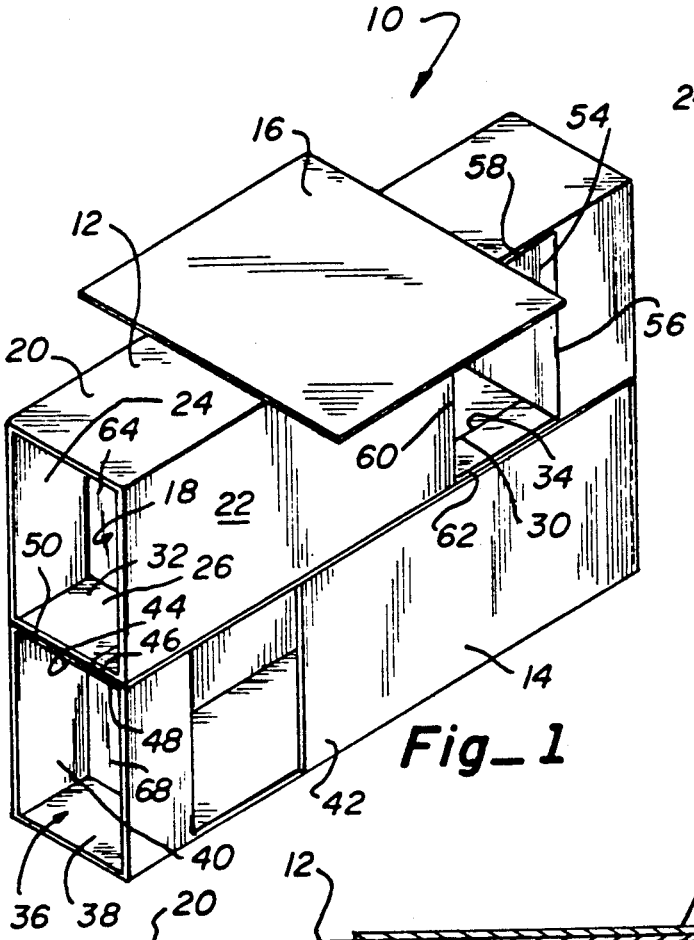
FIG. 1 is a perspective view of an expanded double-tubular void filler according to the present invention.
Figure 2:
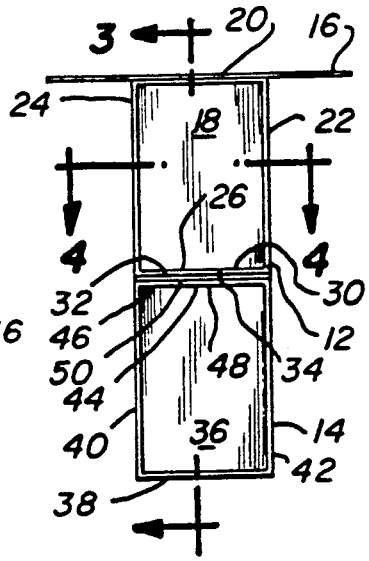
FIG. 2 is a cross-sectional view of the expanded void filler.

DETAILED DESCRIPTION OF THE INVENTION:

Turning now more specifically to FIG. 1, a tubular void filler 10 is shown having a first hollow box-like tube 12 and second hollow box-like tube 14. The common surface between the first tube 12 and second tube 14 can be glued together or suitably attached to form a double tubular structure. The tubular members or tubes 12 and 14 can be formed from heavy corrugated cardboard sheet material or any other suitable material which can be folded and handled to form the desired structure.

A flange sheet 16 can be adhered or attached to the upper surface of the upper or first tube 12 to span the void between the loads when the void filler 10 is in use. In this way, the void filler will hang vertically and fill the space or void between the load or cargo. The upper tubular member or tube 12 has a hollow interior 18 and is comprised of upper surface 20, side surfaces 22, 24 and lower surface 26. The lower surface 26 is made up of flaps 30, 32. The total width of flaps 30, 32 is equivalent to the width of the member 12 and the upper surface 20. In this way, a rectangular cross section can be formed for the upper member or tube 12.

It is naturally understood that the height dimensions of the sides 22, 24 and width dimensions of the surfaces 20, 26 can be changed or varied depending upon the void filler size desired and the intended use or purpose of the void filler. Thus, it is obvious that the tube 12 could be square or rectangular having the long dimension either horizontal or vertical. It also should be noted that the flaps 30, 32 are of substantially different width so that the butt line or joint 34 formed by the abutting edges of the flaps 30, 32 is offset from the center of the surface 26.

In the same way, the lower member or tube 14 has a hollow interior 36 which is defined by lower surface 38, side surfaces 40, 42, and upper surface 44. The upper surface 44 in this illustration is made up of flaps 46, 48. The inner edges of flaps 46, 48 abut at joint or butt line 50. As previously discussed, the flaps 46, 48 have a combined width which is the same as lower surface 38. In addition, the flap 48 as illustrated is considerably wider than flap 46 which places the joint or butt line 50 closer to the left side of the void filler as seen in FIG. 1. This is just the opposite of the position of the butt line 34 for the lower surface of the upper tube 12. As a practical matter, it is feasible that the flaps 30, 32 making up the lower surface 26 of the upper tube 12 and the flaps 46, 48 making up the upper surface 44 of the lower tube 14 can have a width ratio of approximately 2:1. This would offset the upper butt line 34 approximately one-third of the width of the void filler from the lower butt line 50.

The upper and lower tubes 12, 14 are joined together by any suitable arrangement such as an adhesive. The outer surface of the lower surface 26 and the upper surface 44 are coated with the adhesive and then positioned in aligned contact with each other usually so that the sides of the upper and lower tubes are aligned and smooth. This is not to say, however, that the tubes cannot be offset slightly to one side or the other depending upon the particular intended use. With the butt lines 34, 50 staggered, it can be seen that the joining together of the lower surface 26 of tube 12 and upper surface 44 of tube 14 produces a rigid composite layered structure. This construction produces a relatively strong lateral surface which has a relatively high compressive strength. This is an important feature of the structure which holds the load or cargo in place when the void filler 10 is in use.

Figure 3:
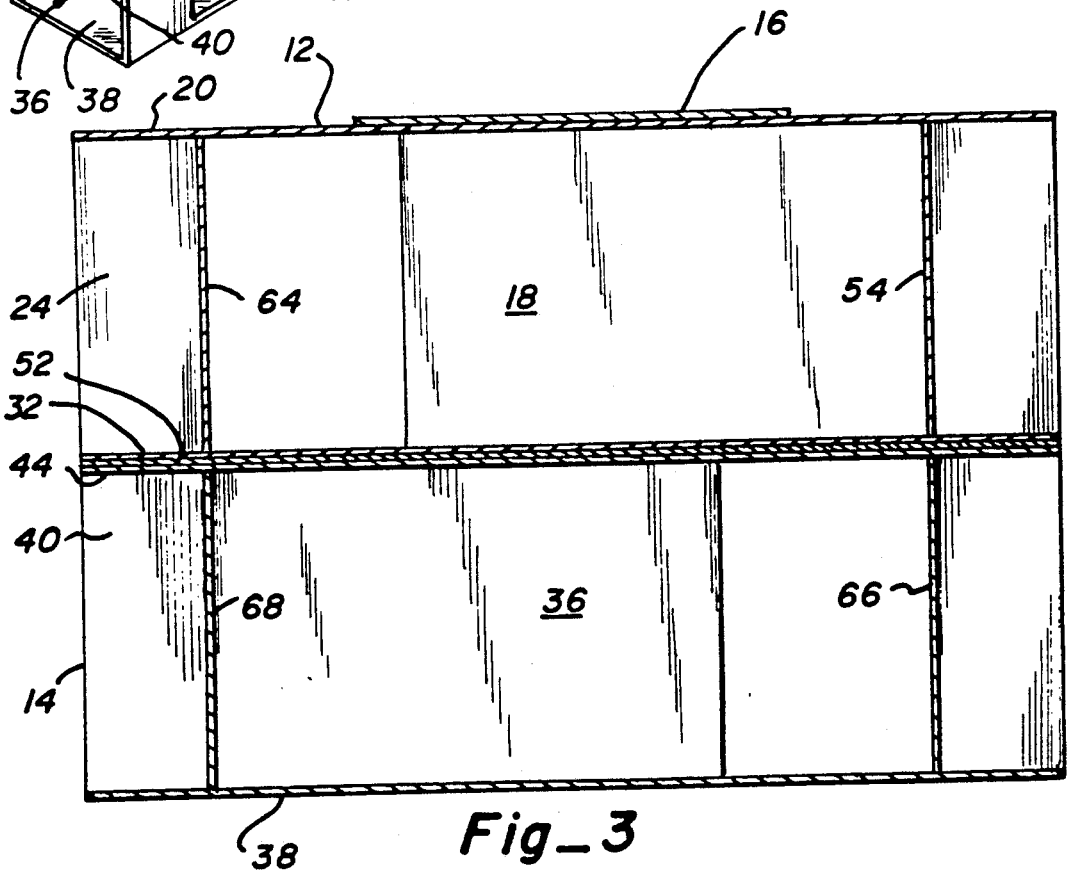
FIG. 3 is a cross-sectional view taken along lines 3—3 of FIG. 2.
Figure 4:
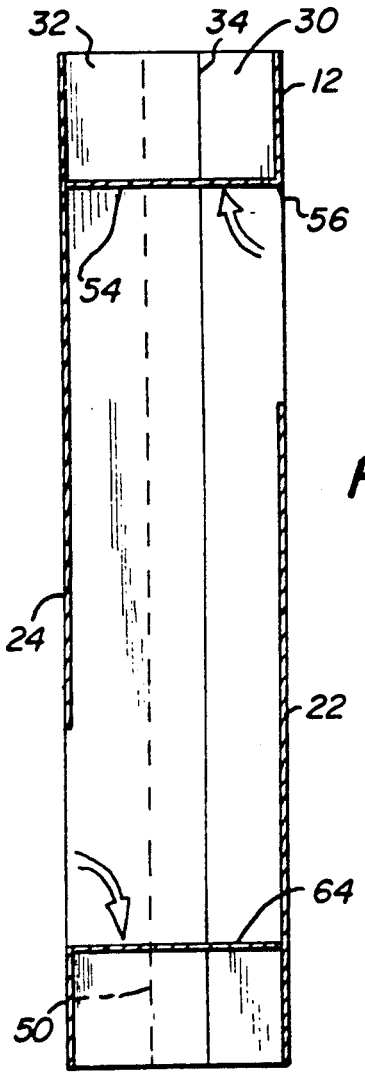
FIG. 4 is a horizontal cross-sectional view taken along lines 4—4 of FIG. 2.

As an additional embodiment for reinforcing the void filler structure which has just been described it is also possible to add an extra piece of sheet material which has the same size as the upper or lower surfaces of either of the tubes 12 or 14 and this sheet 52 can be sandwiched in between the lower surface 26 of tube 12 and the upper surface 44 of tube 14. This produces a layered type structure as can be seen in FIG. 3. The sheet 52 can be fabricated from any suitable material such as corrugated cardboard having one, two or more layers, paper, plastic, metal or plywood. The actual material that is used is usually determined by the compressive strength that is required for the intended use of the void filler 10.

Up to now, a foldable and expandable void filler structure has been described. One of the unique features of the present invention is the arrangement that is used to hold the void filler tubes 12, 14 in the expanded configuration when the void filler is in use. The structure which holds the tubes 12, 14 in the expanded configuration is one or more folding panels which are formed in each tube.

The upper tube 12 includes a panel 54 which is folded inwardly along fold line 56. The other three edges of the panel, 58, 60, 62 are cut from the appropriate surface. The edge fold line 56 and the cut edge 60 are formed vertically along the full height of the side surface 22. The horizontal edges 58, 62 of the panel 54 are cut to correspond with the fold lines at the upper and lower edges of the side surface 22 which join with the upper surface 20 and the flap 30 partially forming the lower surface 26. The length of the horizontal cut edge of the folding panel 54 is the width of the interior of the tube 12 which is the same as the width of the surfaces 20, 26. In fact, the length of the panel 54 can be slightly greater than the width of the surfaces 20, 26 in order to provide interference so that the panel 54 when folded inwardly at right angles with the side surfaces 22, 24 will be wedged against the interior side of the side surface 24 and in contact with the upper surface 20 and lower surface 26. In this way, the folding panel 54 will be held in rigid expanded position by the friction between the surfaces and the panel. The positioning of the panel 54 produces a support which holds the tube 12 in this expanded configuration. In addition, the folding panel 54 also adds to the lateral compressive strength of the tube 12. This strength along with the lateral compressive strength of the upper surface 12, lower surface 38 and the sandwich structure between the lower and upper surfaces 26, 44 produces a substantially rigid structure.

As can be seen, the fold line 56 which is provided for the folding panel 54 is spaced inwardly from the edge of the tube 12. This spacing is provided to balance the structure and retain the inherent strength that is present in the end portion of the tube 12. While it is possible to retain the tube 12 in its expanded configuration by the use of one folding panel, it is anticipated that at least two panels, each spaced inwardly from each end of the tube 12 will be used to maintain symmetry. It is also to be understood that any number of panels can be used within limits to retain the structural integrity of the sides of the tube 12. If desired, the panels can be formed in the upper and/or lower surfaces instead of the side surfaces. It should also be understood that the use of the terms sides, upper and lower to identify the surfaces of the tube is for illustrative purposes and is not to limit the positioning of the sides with respect to the vertical.

Also to retain the structural integrity of the sides of the tube 12, it is desirable that the panels be alternated with respect to each side as illustrated in FIG. 1. Thus, if only two folding panels are intended, one panel would be cut from one side while the additional panel would be spaced near the opposite end and cut and folded from the opposite side of the tube. Where two tubes are stacked one on top of the other, it is desirable that the side folding panels be staggered from one end to the other with respect to the respective tubes so that the cutouts are not vertically aligned in the stacked tubes. This can be easily seen in FIG. 1. In this figure, the tube 12 has a folding panel 54 formed near the right end of the upper tube 12 and another folding panel 64 formed in the opposite side surface 24 and near the opposite end of the tube 12.

Although only the details of the cut edges and fold line are described for forming panel 54, it is to be understood that the other folding panels are identical and have the same structure. With respect to the individual cutouts and fold line for the panels, it is illustrated that the fold line for the panels is usually located nearest to the end edges of the tubes. This is not absolutely necessary, but is used for uniformity to keep the flap fold lines near the ends of the tubes to maintain rigidity in the structure.

Figure 5:
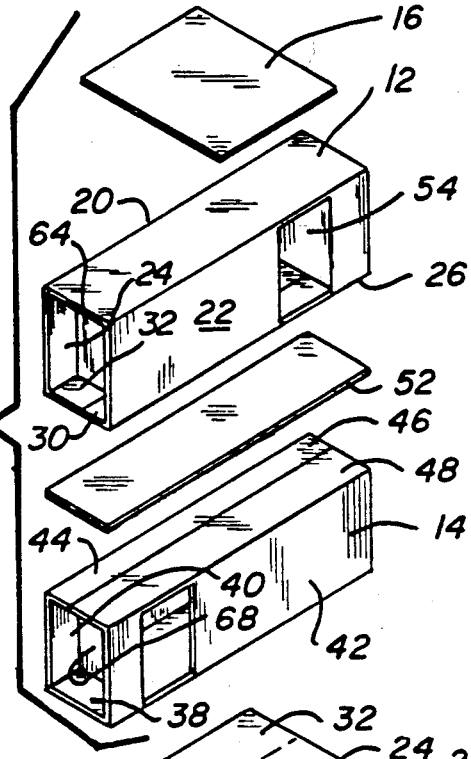
FIG. 5 is a pictorial view showing the individual components.
Figure 6:
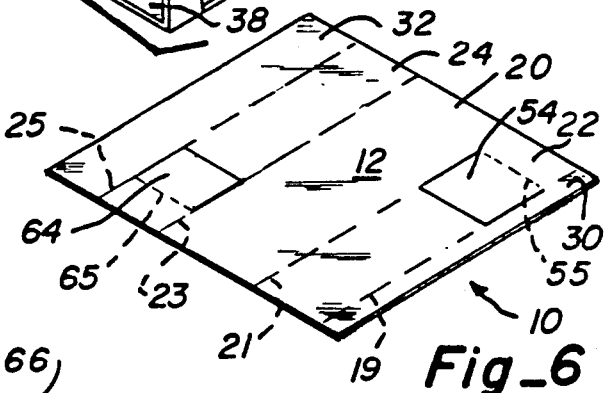
FIG. 6 is a perspective view of a sheet material blank which is used to form one of the tubular members.

FIG. 6 shows a blank 70 which is used to form the upper tube 12. The blank 70 is scored longitudinally to form fold lines 19, 21, 23, and 25. Fold line 19 joins flap 30 to side surface 22. By the same token, fold line 21 connects the side surface 22 to the upper surface 20 with the opposite fold line 23 connecting the edge of surface 20 with side surface 24 and fold line 25 connecting the edge of side surface 24 with lower flap 32. Appropriate cuts which can be die cuts are made to form folding panels 54 and 64. The fold lines 55, 65 for the panels are scored to allow the panels to easily fold inwardly. The tube 12 is then formed by folding the blank 70 along the fold lines 19, 20, 23, 25, while at the same time a blank which can be a mirror image of the blank 70 is folded upwardly in the opposite direction to form the tube 14. Naturally, the blank which is used to form the tube 14 is actually turned over so that the folding flaps will be in the proper position so that the butt lines are staggered in the final construction. The assembly of the void filler device is shown in FIG. 5. As previously described, the upper and lower tubes 12, 14 are joined together along the lower surface 26 of the tube 12 and the upper surface 44 of tube 14. Suitable adhesive or other fastening means are used to join these surfaces together in a rigid structure. In addition to or instead of the adhesive, it is possible to use various types of mechanical fasteners to hold the tubes together such as a post and slide clip or nuts, bolts and washers, if desired. Naturally, it is necessary if mechanical fasteners are used to leave the area that is swept by the folding panels open so as not to interfere with the movement of the panels. Also, it is possible to use an additional sheet member 52 as a sandwich between the upper and lower tubes to provide additional rigidity and compressive strength in the final product.

Figure 7:
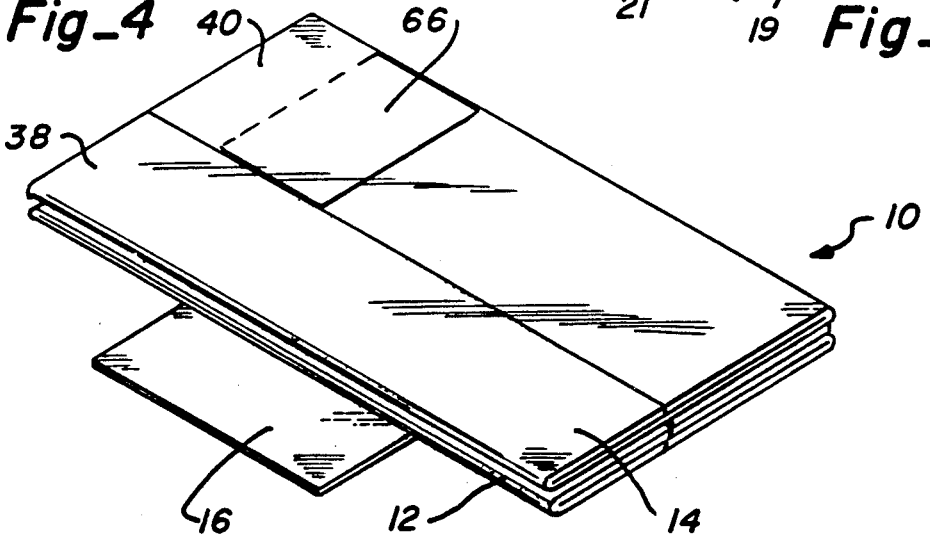
FIG. 7 is a pictorial view showing the void filler of FIG. 1 in the collapsed configuration.
Figure 8:
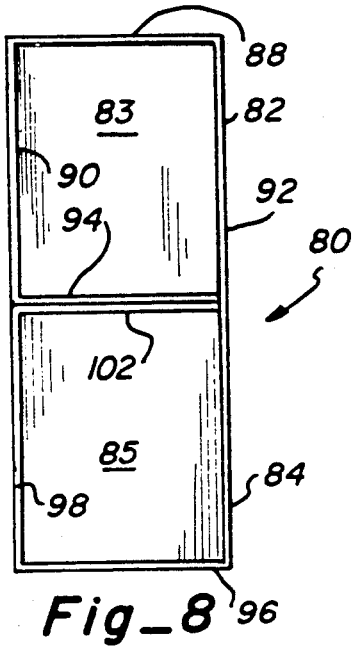
FIG. 8 is an end view showing a double tube void filler according to the present invention formed entirely from a single sheet of material.

Shipped with the foldable panels unfolded in alignment with the side surfaces, the assembled void filler can be folded to a collapsed configuration as shown in FIG. 7. In this figure, the void filler 10 is turned over with the flange 16 resting on a support surface. In actual use the void filler would be turned over and the folding panels folded inwardly until they are approximately 90 degrees with respect to the side surfaces. This is the expanded configuration as shown in FIG. 1. In this configuration, the void filler is quickly and easily expanded and configured into a rigid structure which can be easily positioned between or on top of the load or cargo.

Figure 11:
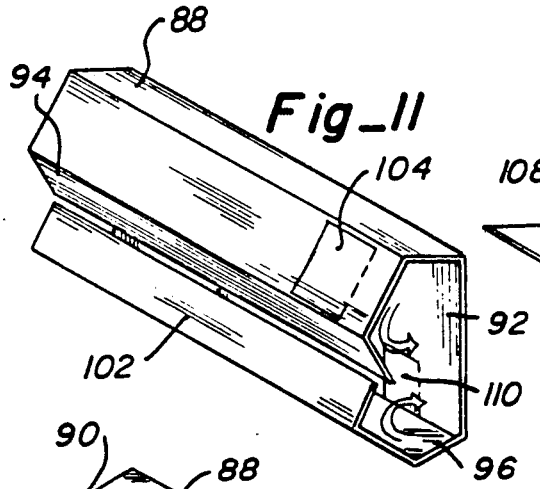
FIG. 11 is a perspective view showing a further folding of the blank of FIG. 9.
Figure 12:
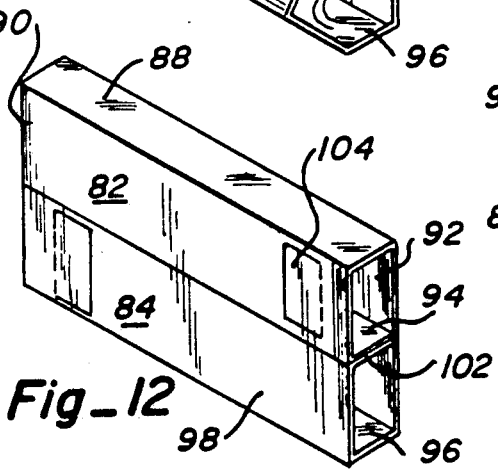
FIG. 12 is a perspective view showing the assembled double tube void filler blank before the support panels are folded inwardly.
Figure 13:
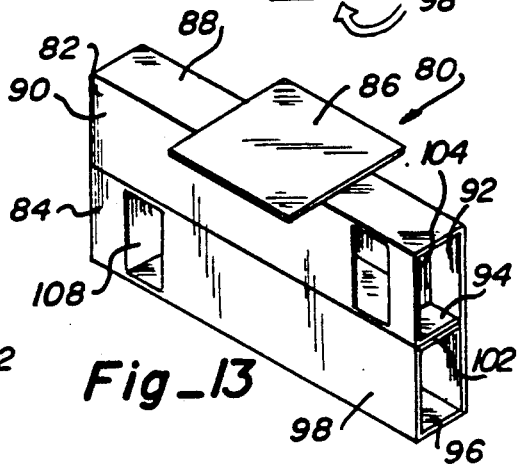
FIG. 13 is a perspective view of the assembled double tube void filler blank including a flange sheet for supporting the void filler in use.

Another embodiment of the void filler is shown in FIGS. 8–13. In FIG. 13 an erected or expanded void filler 80 is shown which is essentially identical to the expanded structure which has previously been described. The primary difference in this product is the method which is used to fabricate the product.

As shown in FIG. 13, the void filler 80 includes upper tube or hollow box-like member 82 and lower tube or hollow box-like member 84. A separate sheet of suitable material 86 which serves as a flange for supporting the void filler is suitably fastened to the upper surface 88 of the upper tube 82. The upper tube 82 includes the upper surface 88, side surfaces 90, 92 and lower surface 94. By the same token, the lower tube 84 includes the lower surface 96, side surfaces 98 and 100 and upper surface 102. Folding panels 104, 106 are provided in the opposite side surfaces of the upper tube 82 and folding panels 108, 110 are provided on opposite side surfaces in the lower tube 84.

Figure 9:
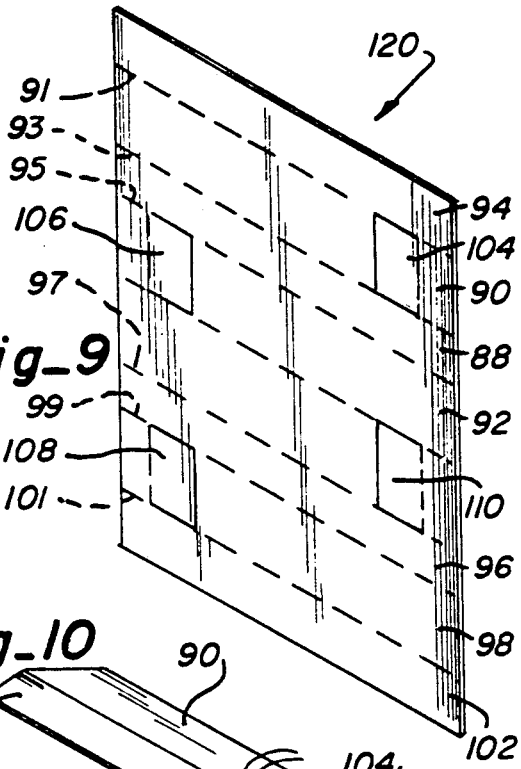
FIG. 9 is a perspective view of the blank used to form the double tube void filler shown in FIG. 8.

In the present embodiment as shown in FIG. 9, a single blank 120 composed of a suitably sized sheet of corrugated cardboard is provided. The desired surfaces are formed by scoring a plurality of fold lines laterally across the blank as shown in the drawing. The fold lines are spaced at proper dimensions from top to bottom to form the various upper, lower and side surfaces forming both tubes 82 and 84.

As seen in FIG. 9, the top panel 94, which is the lower surface of the upper tube 82, is connected to the side surface 90 by fold line 91. Fold line 93 in turn, connects side panel 90 to upper panel 88 with fold line 95 connecting upper panel 88 to the oversized side panel 92. The side panel 92 has a length which encompasses both of the side surfaces of the upper and lower tube 82, 84. Fold line 97 is provided between the side surface 92 and bottom surface 96 of lower tube 84. Fold line 99 lies between and joins the lower surface 96 and side surface 98 with fold line 101 providing the connection between the side surface 98 and upper surface 102 of the lower tube 82.

Foldable panels 104, 106 and 108, 110 are strategically located and positioned in the proper place on the various side surfaces to provide the desired folding characteristics in the finished unit.

Figure 10:
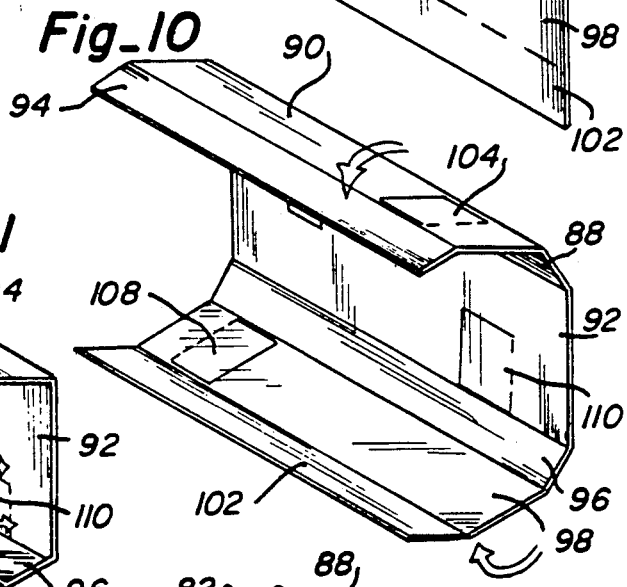
FIG. 10 is a perspective view showing the partial folding of the blank of FIG. 9.

FIGS. 10–12 show the folding process that is required to form the double tube construction. The uppermost and lowermost panels 94, 102 of the blank 120 are folded inwardly towards the left as illustrated in the drawing. Each of the fold lines are folded until the folds are approximately at right angles with each other. In this way, surfaces 94 and 102 come together to overlay each other and extend across the central portion of the void filler 80. The corresponding adjacent surfaces of the lower surface 94 and upper surface 102 of the tubes 82, 84 are joined together by suitable adhesive or other arrangement to bond or hold the surfaces together. No attempt is made to join the free ends of the surfaces 94, 102 with the inner surface of side 92. This arrangement allows free folding movement of the foldable panels, and it has been found that it is unnecessary to actually attach or support the ends of the surfaces 94, 102 until the filler is used. A suitable flange sheet 86 can be adhered or fastened to the upper surface 88 of the upper tube 82. In this configuration, the void filler 80 can be collapsed into a folded position similar to that shown in FIG. 7 or the void filler can be retained in the expanded upright configuration by folding the panels inwardly to approximately a right angle position. Again, although any number of foldable panels can be provided, only four panels are shown for illustration purposes and these four panels have been found to be quite satisfactory in obtaining the desired results.

In the arrangement which has been described for this embodiment, a unique method is provided for easily and quickly forming the void filler product by the use of a single blank sheet of material. The scoring of the necessary fold lines and the scoring and die cutting of the foldable panels can be easily done in a one or two-step operation.

If desired, the blank can be easily shipped to a location where the remainder of the fabrication can take place or to the location where the void filler is to actually be used. Thus, with the blank available, the void filler can be easily assembled with the adjacent surfaces glued together or held together with suitable mechanical fastening devices such as clamps or other fasteners. By the same token, the flange can also be attached to the double stacked tubes by glue or other suitable adhesives or by mechanical fasteners. By the use of mechanical fasteners, it is possible to disassemble the void filler so as to remove the flange and allow the unit to be disassembled back into a flat blank configuration. This in itself will help to alleviate storage and transportation considerations or problems.

As explained above, any suitable material which will provide the required or necessary compressive strength may be used. These materials can cover a wide gambit such as corrugated cardboard or paperboard, fiber materials, plastics or soft bendable metal.

While an expandable void filler has been shown and described in detail in this application, it is to be understood that this invention is not to be limited to the exact form disclosed and changes in the detail and construction of the void filler may be made without departing from the spirit thereof.

What is claimed is:

1. An expandable void filler for supporting and stabilizing cargo being transported in a vehicle, said void filler being used to fill spaces that may exist between stacked loads making up the cargo, the void filler being capable of being folded to a flat configuration for storage and shipping and quickly opened to an expanded configuration to fill the spaces between the loads, the void filler comprising:

a) a first hollow, elongated, open-ended, box-like tube having four outer surfaces, said four outer surfaces being connected along their respective, contiguous edges by fold lines whereby the tube has a continuous perimeter;

b) a second hollow, elongated, open-ended, box-like tube having four outer surfaces, said four outer surfaces being connected along their respective, contiguous edges by fold lines whereby the tube has a continuous perimeter;

c) said first and second tubes being arranged with one surface of each tube being aligned and overlapping with the other, said aligned and overlapping surfaces being attached by suitable means; and d) said first and second tubes each having at least one folding panel formed in a surface which is not one of the contiguous surfaces, each of said folding panels having a size which is the same as an interior cross-section of the respective tube, one edge of each of said folding panels is a fold line arranged parallel to the end edge of the corresponding surface of the tube in which said panel is formed, said folding panels being arranged to pivotally fold across the interior of the tube to a position perpendicular with the other three surfaces of the tube and to contact at least one other surface to hold the tubes rigid while in use.

2. An expandable void filler as defined in claim 1 which further includes a flange means joined by suitable means to the outside of the surface opposite aligned and contiguous surface of the first tube, said flange means being sufficiently large to overlap the loads whereby the void filler can be suspended between the cargo loads to fill the space between the loads and keep the loads from shifting during transportation.

3. An expandable void filler as defined in claim 2 wherein said flange means is a flat sheet of material made fromsame material the same as the first tube.

4. An expandable void filler as defined in claim 1 wherein the attachment means is an adhesive means which permanently joins together the contiguous surfaces of said first and second tubes.

5. An expandable void filler as defined in claim 1 wherein the overlapping surfaces of the first and second tubes are formed by pairs of inwardly folding flaps joined by fold lines to the corresponding respective adjacent surfaces, one flap of each pair having a greater width dimension than the other so that the outer edges of each pair of flaps abut at a line which extends the length of said tube, the width of the individual flaps making up the overlapping surfaces of the tubes are predetermined so that the butt lines of the individual tube surfaces are offset so that the surfaces when joined by the attachment means will have rigidity and strength.

6. An expandable void filler as defined in claim 5 wherein the overlapping surfaces of the tubes have the same width dimension.

7. An expandable void filler as defined in claim 1 wherein a piece of sheet material having generally the same dimensions as the contiguous surfaces of said first and second tubes is positioned and attached between said first and second tubes to provide additional reinforcement and compressive strength to the expandable void filler.

8. An expandable void filler as defined in claim 1 wherein each of the first and second tubes have two or more folding panels; each of said folding panels are formed in opposing surfaces of the respective tube and the folding panels are staggered with respect to the adjacent surfaces of the first and second tubes.

9. An expandable void filler as defined in claim 8 wherein the fold line for each of the folding panels is spaced from the end edges of the respective tubes.

10. An expandable void filler as defined in claim 1 wherein a pair of opposite surfaces of each of the tubes have the same width and the two remaining surfaces of each of the tubes have the same width.

11. An expandable void filler as defined in claim 10 wherein the length of the tubes are the same.

12. An expandable void filler as defined in claim 1 wherein the surfaces of the tubes are formed from corrugated cardboard sheet material.

13. An expandable void filler as defined in claim 1 which further includes one or more additional hollow, elongated, open-ended, box-like tubes each having four outer surfaces, each of said four outer surfaces being connected along their respective, contiguous edges by fold lines whereby the tube has a continuous perimeter, and the four outer surfaces have substantially the same width as the four outer surfaces of said first and second tubes, and said additional tubes are attached by a surface to a surface of the tube immediately adjacent to form a series of tubes which can be arranged to form a predetermined stacked configuration.

* * * * *